US012636556B1

(12) United States Patent
Rauer

(10) Patent No.: US 12,636,556 B1
(45) Date of Patent: May 26, 2026

(54) HINGED GOLF TEE ASSEMBLY

(71) Applicant: Ice Tees LLC, Fort Lupton, CO (US)

(72) Inventor: Dalton C. Rauer, Fort Lupton, CO (US)

(73) Assignee: Ice Tees LLC, Fort Lupton, CO (US)

( * ) Notice: Subject to any disclaimer, the term of this patent is extended or adjusted under 35 U.S.C. 154(b) by 0 days.

(21) Appl. No.: 19/349,946

(22) Filed: Oct. 3, 2025

(51) Int. Cl.
*A63B 57/13* (2015.01)
*A63B 57/20* (2015.01)

(52) U.S. Cl.
CPC ..... *A63B 57/13* (2015.10); *A63B 57/203* (2015.10)

(58) Field of Classification Search
CPC ..... A63B 57/13; A63B 57/203
See application file for complete search history.

(56) References Cited

U.S. PATENT DOCUMENTS

| | | | | |
|---|---|---|---|---|
| 1,717,962 | A | 6/1929 | Deike | |
| 1,866,143 | A | 7/1932 | Willey | |
| 1,942,672 | A | 1/1934 | Howard | |
| 2,712,939 | A * | 7/1955 | Harp | A63B 57/19 473/265 |
| 8,936,521 | B2 | 1/2015 | Lee | |
| 9,216,338 | B1 | 12/2015 | Lee et al. | |
| 9,339,706 | B2 | 5/2016 | Black, Jr. et al. | |
| 9,833,672 | B1 | 12/2017 | Montejo | |
| 2015/0105182 | A1 | 4/2015 | Black, Jr. et al. | |
| 2016/0325159 | A1 | 11/2016 | Black, Jr. et al. | |
| 2018/0193709 | A1 * | 7/2018 | Pope | A63B 57/19 |

FOREIGN PATENT DOCUMENTS

| | | | | |
|---|---|---|---|---|
| AU | 3031495 A | * | 3/1996 | A63B 57/10 |
| GB | 2408944 A | * | 6/2005 | A63B 69/3623 |
| KR | 20030025989 A | * | 3/2003 | |
| KR | 100701333 B1 | | 4/2007 | |

* cited by examiner

*Primary Examiner* — Audrey B. Walter
(74) *Attorney, Agent, or Firm* — Stephen B. Katsaros; Patent Engineering, LLC

(57) ABSTRACT

A golf tee assembly includes a base with turf engagement members for ground insertion and a hinged tee holder that pivots when struck by a golf club. The hinge member contains a cavity for removably receiving a tee shaft and rotates about a horizontal axis to deflect upon impact, protecting the tee shaft from damage. The assembly may be manufactured as a single unit using 3D printing.

15 Claims, 10 Drawing Sheets

HINGED GOLF TEE ASSEMBLY

TECHNICAL FIELD

The present disclosure relates to golf equipment. More particularly, the disclosure relates to golf tee assemblies configured to support a golf ball during play. The assemblies provide enhanced durability and reusability through a hinged mechanism. The hinged mechanism allows the golf tee to deflect upon impact rather than break.

BACKGROUND

Golf tees are commonly used to elevate golf balls above the ground surface during tee shots, providing golfers with optimal ball positioning for driving. Traditional golf tees are typically constructed as single-piece wooden or plastic stakes that are inserted directly into the ground. When struck by a golf club during a swing, these conventional tees often break or become damaged, requiring frequent replacement during a round of golf.

SUMMARY

Golf is a multi-billion-dollar industry with millions of participants worldwide who collectively purchase hundreds of millions of golf tees annually. Traditional wooden and plastic golf tees suffer from a fundamental design flaw: they break upon impact with golf clubs, creating waste, interrupting play, and requiring constant replacement. Professional golfers and recreational players alike have long sought a reusable tee solution that maintains consistent ball positioning while withstanding the substantial impact forces generated during golf swings, which can exceed 150 miles per hour at the point of contact.

According to an aspect of the present disclosure, a golf tee assembly is provided. The golf tee assembly comprises a base member having a top surface and a bottom surface disposed opposite the top surface, as well as at least one turf engagement member extending downwardly from the bottom surface and configured to engage with a ground surface. The golf tee assembly further comprises a hinge member pivotally connected to the base member and configured to rotate about a substantially horizontal hinge axis. The hinge member comprises a hole extending therethrough and configured to receive a tee shaft in removable engagement. The hinge member is configured to pivot from an upright position to a deflected position when subjected to an impact force from a golf club, thereby allowing the tee shaft to move downwardly and laterally without becoming damaged.

According to other aspects of the present disclosure, the golf tee assembly may include one or more of the following features. The hinge member may be configured to automatically return to the upright position after deflection due to a biasing force provided by the structural configuration of the hinge member and base member connection. The hole may extend completely through the hinge member from a top end to a bottom end and may be configured to removably receive the tee shaft in a friction-fit engagement that securely holds the tee shaft. The hole may comprise at least one registration feature configured to align the tee shaft with the hinge member, the registration feature providing rotational orientation between the tee shaft and the hinge member to maintain proper positioning during use. The hinge axis may be positioned below a top surface of the base member and above the bottom surface, allowing the hinge member to pivot through a predetermined range of motion while remaining operatively connected to the base member. The hinge member may comprise at least one pin extending laterally therefrom, and the base member may comprise at least one corresponding recess configured to receive the at least one pin, thereby forming the pivotal connection between the hinge member and the base member. The base member may comprise a retention collar positioned around the hinge member and configured to prevent the hinge member from separating from the base member during rotation while allowing free pivotal movement. The top surface of the base member may comprise at least one digit engagement surface comprising a textured or contoured configuration to facilitate secure gripping of the golf tee assembly by a user's fingers during installation and removal. The golf tee assembly may be formed as a single integrated unit through additive manufacturing processes, wherein a pin formed on the hinge member and a corresponding hole formed in the base member are initially frangibly connected and subsequently separated to enable pivotal movement.

According to another aspect of the present disclosure, a method of using a golf tee assembly is provided. The method comprises positioning a base member on a ground surface, the base member having a top surface, a bottom surface disposed opposite the top surface, and at least one turf engagement member extending downwardly from the bottom surface. The method further comprises inserting a tee shaft into a hole of a hinge member that is pivotally connected to the base member and configured to rotate about a substantially horizontal hinge axis. The method additionally comprises placing a golf ball on the tee shaft and striking the golf ball with a golf club, wherein the impact force causes the hinge member to pivot from an upright position to a deflected position, thereby allowing the tee shaft to move downwardly and laterally without becoming damaged.

According to other aspects of the present disclosure, the method may include one or more of the following features. The method may further comprise allowing the hinge member to automatically return to the upright position after deflection due to a biasing force provided by the structural configuration of the hinge member and base member connection. Inserting the tee shaft may comprise removably receiving the tee shaft in a friction-fit engagement within the hole that extends completely through the hinge member from a top end to a bottom end. Inserting the tee shaft may further comprise aligning the tee shaft with the hinge member using at least one registration feature within the hole/central cavity, the registration feature providing rotational orientation between the tee shaft and the hinge member to maintain proper positioning during use. Positioning the base member may comprise engaging the at least one turf engagement member with the ground surface while the hinge axis remains positioned below the top surface of the base member and above the bottom surface. Positioning the base member may comprise engaging at least one pin extending laterally from the hinge member with at least one corresponding recess in the base member to form the pivotal connection. The method may further comprise gripping at least one digit engagement surface on the top surface of the base member during positioning, the digit engagement surface having a textured or contoured configuration to facilitate secure gripping by a user's fingers. The golf tee assembly may be formed as a single integrated unit through additive manufacturing processes, and the method may further comprise separating a frangible connection between a pin formed on the hinge member and a corresponding hole formed in the base member to enable pivotal movement prior to use.

Further areas of applicability of the present disclosure will become apparent from the detailed description provided hereinafter. It should be understood that the detailed description and specific examples while indicating various configurations, are intended for purposes of illustration only and are not intended to limit the scope of the disclosure necessarily.

BRIEF DESCRIPTION OF THE DRAWINGS

The accompanying figures of the drawing, which are included to provide a further understanding of general aspects of the system/method, are incorporated in and constitute a part of this specification. These illustrative aspects of the system/method, together with the detailed description, explain the principles of the system. No attempt is made to show structural details in more detail than is necessary for a fundamental understanding of the system and the various ways in which it is practiced. The following figures of the drawing include.

In the appended figures, similar components and/or features may have the same reference label. Further, various components of the same type may be distinguished by following the reference label with a dash and a second label that distinguishes among the similar components. If only the first reference label is used in the specification, the description applies to any one of the similar components having the same first reference label, irrespective of the second reference label. Where the reference label is used in the specification, the description applies to any similar component with the same reference label.

DETAILED DESCRIPTION

Illustrative configurations are described with reference to the accompanying drawings. Wherever convenient, the same reference numbers are used throughout the drawings to refer to the same or like parts. While examples and features of disclosed principles are described herein, modifications, adaptations, and other implementations are possible without departing from the spirit and scope of the disclosed configurations. It is intended that the following detailed description be considered exemplary only, with the true scope and spirit being indicated by the following claims.

Traditional golf tees present limitations during golf play, particularly when subjected to impact forces from golf clubs. Conventional golf tees may break or become damaged when struck, requiring frequent replacement and interrupting the flow of play. The rigid construction of standard golf tees can result in structural failure upon impact, leading to waste and inconvenience for golfers. Additionally, traditional golf tees may not provide consistent performance across different ground conditions or playing surfaces.

The disclosed golf tee assembly addresses these limitations through a hinged configuration that allows controlled deflection without structural damage. The assembly includes a base member configured to engage with a ground surface, a hinge member pivotally connected to the base member, and a tee shaft removably received within the hinge member. This configuration enables the tee shaft to move downward and horizontally when subjected to impact forces, thereby absorbing energy and preventing breakage. The hinged design allows the assembly to return to an upright position after deflection, providing reusable functionality and consistent performance.

Figure 1:
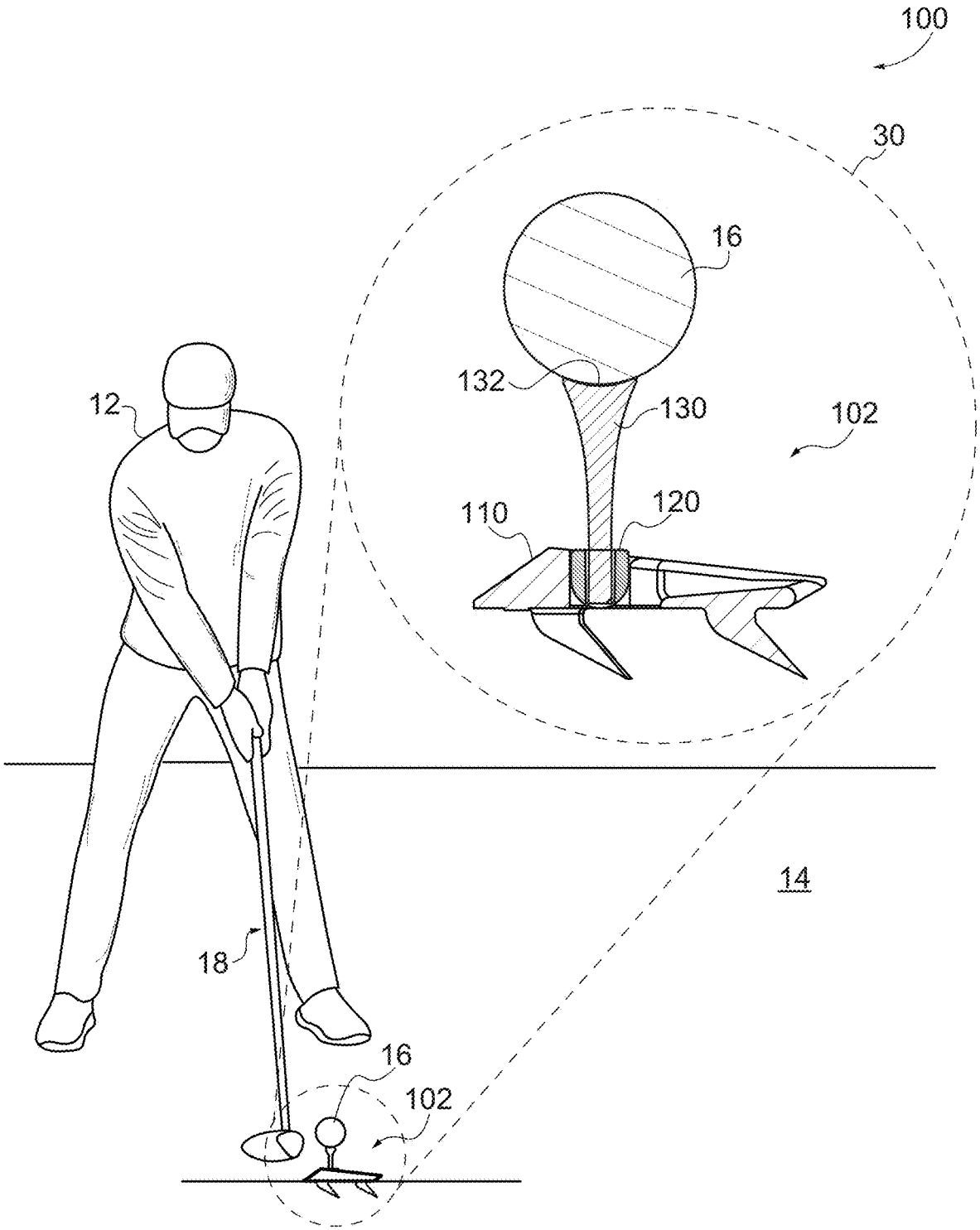
FIG. 1 illustrates a golf drive stance showing a golfer positioned to strike a golf ball supported by a tee assembly on a ground surface.

FIG. 1 illustrates a golf drive stance 100 showing a golfer 12 positioned relative to a ground surface 14 in preparation for striking a golf ball 16 with a golf club 18. The golf drive stance 100 demonstrates the positioning of the golfer 12 during the initial phase of a golf swing. A tee assembly 102 may be positioned on the ground surface 14 to support the golf ball 16 at an elevated position suitable for driving. The tee assembly 102 includes a base member 110 configured to engage with the ground surface 14 and provide stable support for the overall assembly. A hinge member 120 may be pivotally connected to the base member 110, allowing rotational movement about a substantially horizontal axis. The hinge member 120 can receive a tee shaft 130 in removable engagement, with the tee shaft 130 extending upwardly to support the golf ball 16 through a head 132 configured to contact the golf ball 16.

The golf club 18 includes a shaft and a striking surface configured to impact the golf ball 16 during the golf swing. When the golf club 18 strikes the golf ball 16, impact forces may be transmitted to the tee assembly 102 through contact with the tee shaft 130 or direct contact with the hinge member 120. The pivotal connection between the hinge member 120 and the base member 110 allows the hinge member 120 to displace in response to these impact forces, thereby reducing stress concentrations that could lead to structural failure. A circular cross-sectional detail region 30 may highlight the interface between the tee shaft 130 and the hinge member 120, illustrating the removable engagement configuration that secures the tee shaft 130 within the hinge member 120 during use.

In an illustrative configuration, the tee assembly 102 can be manufactured through additive manufacturing processes such as 3D printing, where the build orientation may be configured with layer lines perpendicular to the direction of impact forces. This orientation prevents structural failure along weak layer boundaries that could occur if the layer lines were aligned parallel to the direction of impact. The manufacturing process enables the hinge member 120 and base member 110 to be produced as an integrated unit, with the pivotal connection formed during the manufacturing process. Production as an integrated unit eliminates the need for separate assembly operations while maintaining the functional hinge mechanism. This co-manufacturing with the hinge member 120, formed rotationally adjacent to the base member 110, results in an assembly that remains assembled even when subjected to multiple impacts (or high-energy impacts).

Figure 2:
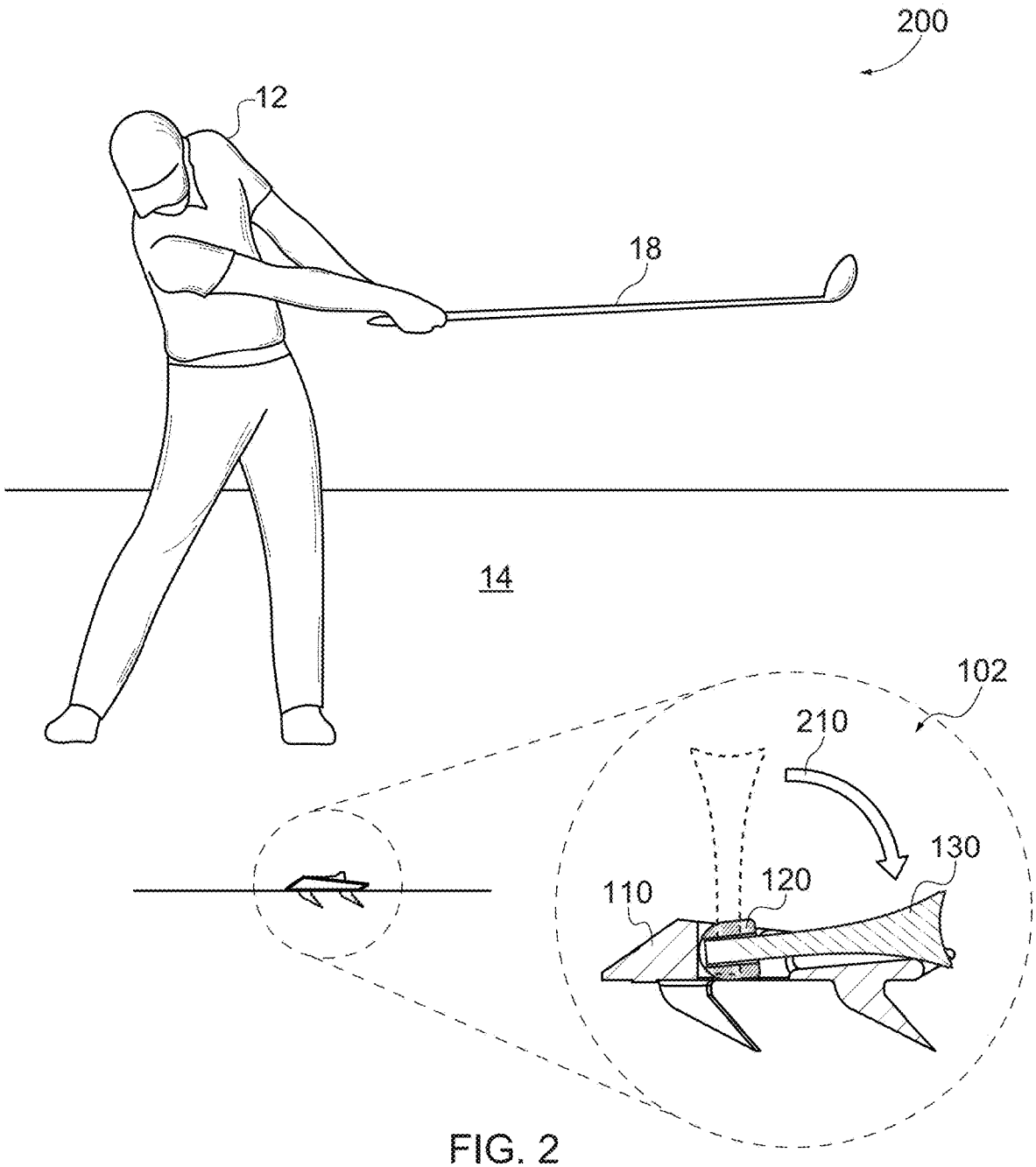
FIG. 2 illustrates an after-drive stance showing the tee assembly deflecting along a downward trajectory when struck by a golf club.

FIG. 2 illustrates an after-drive stance 200 showing the operational behavior of the tee assembly 102 during and immediately following impact with the golf club 18. The after-drive stance 200 demonstrates how the hinge member 120 responds to the impact forces generated when the golfer 12 strikes the golf ball. A tee trajectory 202 indicates the path of movement that the tee shaft 130 of the tee assembly 102 follows during the deflection process. Additionally, a tee trajectory 202 shows the specific directional movement of the hinge member 120 (and the tee shaft 130 attached thereto) as the hinge member 120 pivots away from the upright position to absorb the impact energy. This deflection mechanism enables the tee shaft 130 to move laterally and downward without sustaining the structural damage that typically occurs with conventional rigid tee configurations. The pivotal movement of the hinge member 120 about the substantially horizontal hinge axis enables the tee assembly 102 to flex under impact while maintaining structural integrity for repeated use.

Figure 3:
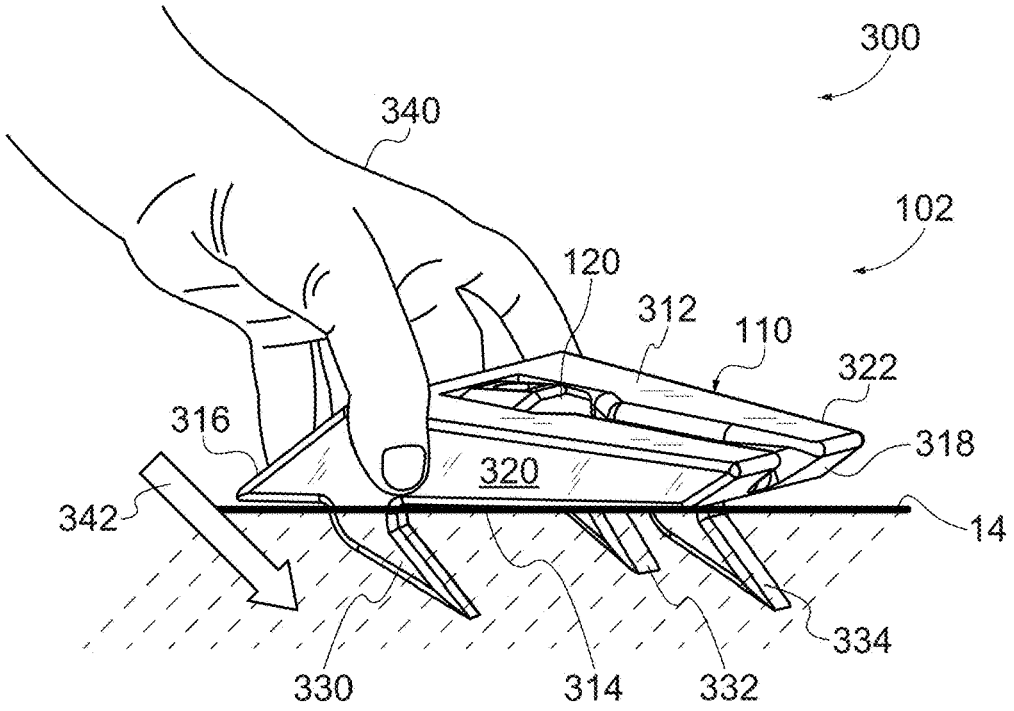
FIG. 3 illustrates an installation view of the golf tee assembly showing a base member with turf engagement members and a hinge member connection.

FIG. 3 illustrates the installation process and ground engagement configuration 300 of the tee assembly 102. The base member 110 includes a top surface 312 and a bottom surface 314 disposed opposite the top surface 312. A back wall 318 extends between the top surface 312 and the bottom surface 314, providing structural support for the hinge member 120 connection. The base member 110 further includes a first side 320 and a second side 322 that define the lateral boundaries of the base member 110. A first turf engagement member 330, a second turf engagement member 332, and a third turf engagement member 334 extend downwardly from the bottom surface 314 to engage with the ground surface 14. A hand 340 demonstrates the installation process by applying downward pressure to push the turf engagement members into the ground surface 14, as illustrated by an installation arrow 342. The base member 110 includes specific angular surfaces that enhance functionality during installation and use, with a forward angle formed between a front face 316 and the ground surface 14 to prevent driver damage by allowing the club head to skip upwards and forward upon impact.

The back wall 318 incorporates an angled surface that forms an angle (angle 1032, FIG. 10) with the ground surface 14, providing a spot for fingertips to reach in and pull the tee assembly 102 up from the ground surface 14 for removal. This angled configuration facilitates easy extraction of the turf engagement members from the ground surface 14 after use. The hinge member 120 connects to the base member 110 through a pivot axis (650, FIG. 6), which allows rotational movement while maintaining a secure attachment. The structural arrangement of the top surface 312, bottom surface 314, and back wall 318 creates a stable platform that supports the hinge member 120 during operation while providing adequate clearance for the pivotal movement during impact deflection.

Figure 4:
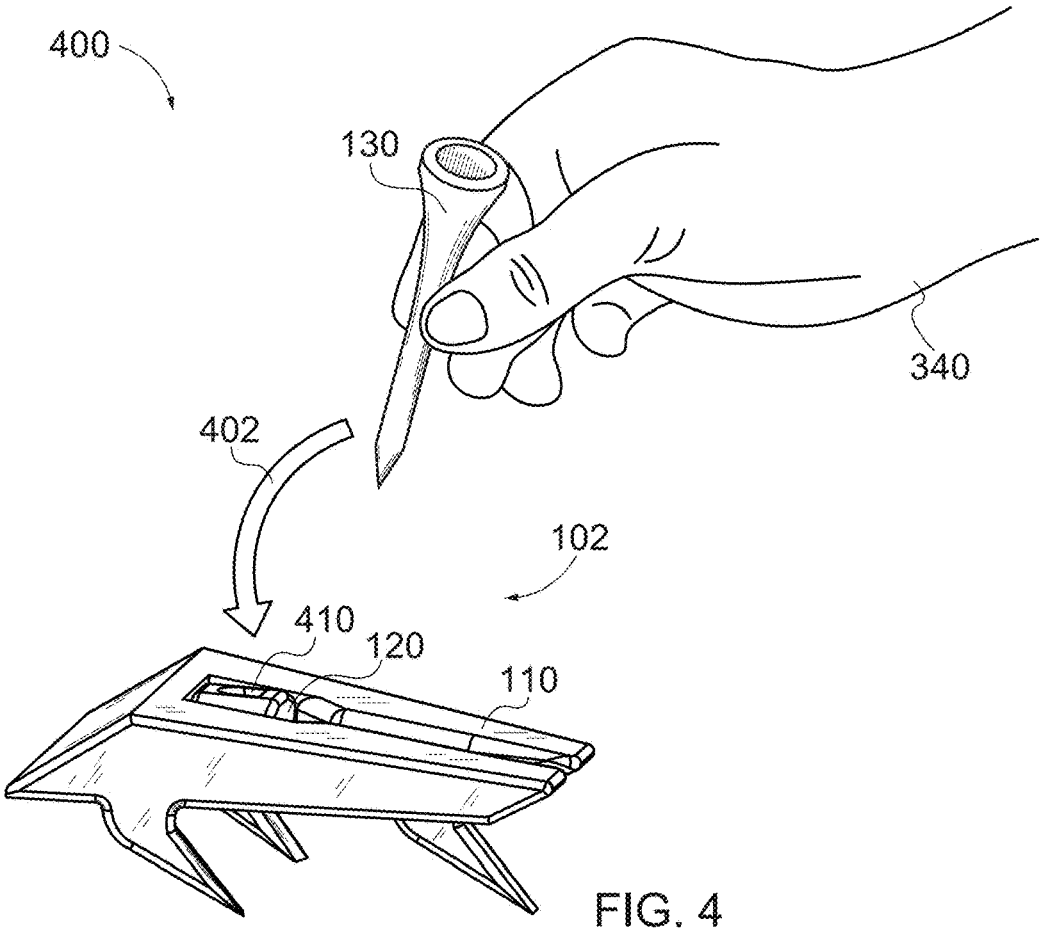
FIG. 4 illustrates a side view showing insertion of a tee shaft into the hinge member during usage.

FIG. 4 illustrates a hand positioning process 400 during the tee shaft insertion process. The hand 340 grips the tee shaft 130 and positions it for insertion into the hinge member 120. An insertion direction 402 indicates the proper orientation for installing the tee shaft 130 into the hole of the hinge member 120. The hinge member 120 includes a hole 410 (also shown in FIG. 6 and sometimes referred to herein as a central cavity) that receives the tee shaft 130 in removable engagement. The insertion process involves aligning the tee shaft 130 with the hole 410 and applying gentle pressure to establish a friction-fit engagement between the tee shaft 130 and the hinge member 120. The hole extends through the hinge member 120 to accommodate various tee shaft lengths while maintaining secure retention during use. The hand position process demonstrates the ergonomic accessibility of the tee shaft installation process, allowing users to insert and remove the tee shaft 130 as needed easily. In some high-energy ball driving events, the tee shaft 130 exits from the hole 410 to protect the components.

Figure 5:
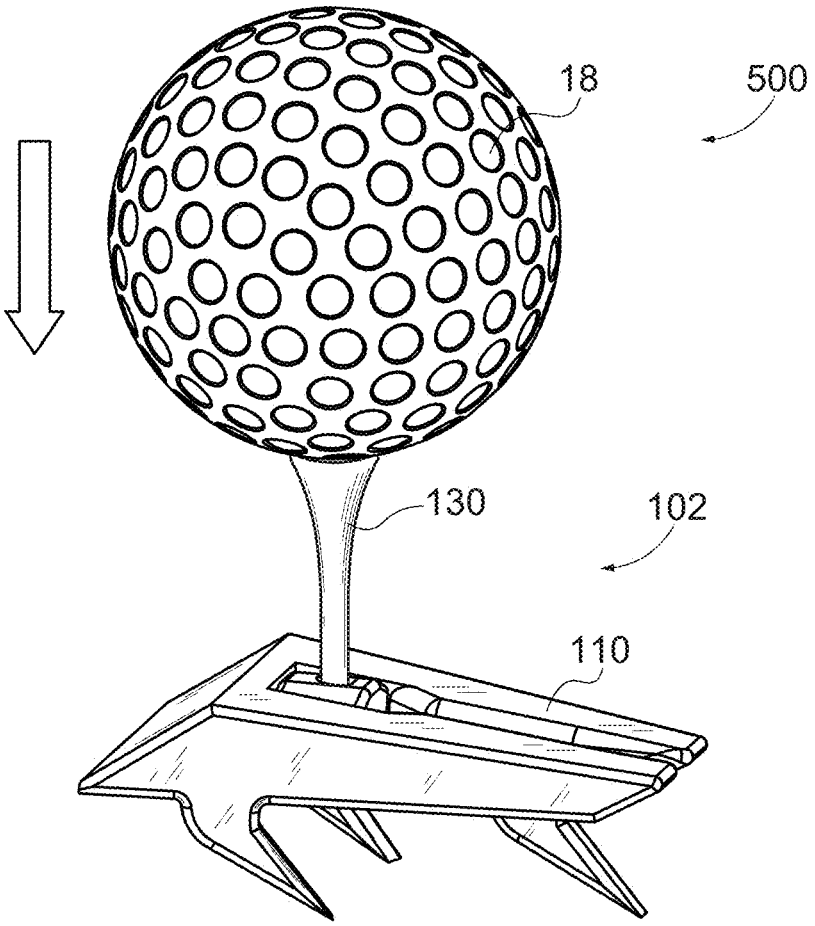
FIG. 5 illustrates a golf ball supported condition showing the tee assembly with a golf ball positioned on the tee shaft.

In an illustrative configuration, FIG. 5 shows a golf ball in a supported condition 500, indicating the completed assembly ready for use. The tee assembly 102 supports a golf ball 18 positioned on the tee shaft 130. The golf ball 18 rests securely on the upper portion of the tee shaft 130, which extends upwardly from the hinge member 120. The golf ball supported condition 500 demonstrates the stable positioning achieved when the tee shaft 130 engages with the hole 410 (sometimes referred to herein as the central cavity) of the hinge member 120. The hinge member 120 maintains the tee shaft 130 in an upright orientation while remaining ready to pivot upon impact. The golf ball supported condition 500 represents the operational state where the tee assembly 102 provides consistent ball height and positioning for the golfer. The structural relationship between the base member 110, hinge member 120, and tee shaft 130 creates a reliable support system that accommodates the dynamic forces encountered during golf ball striking while protecting the tee shaft 130 from damage through the controlled deflection mechanism.

Figure 6:
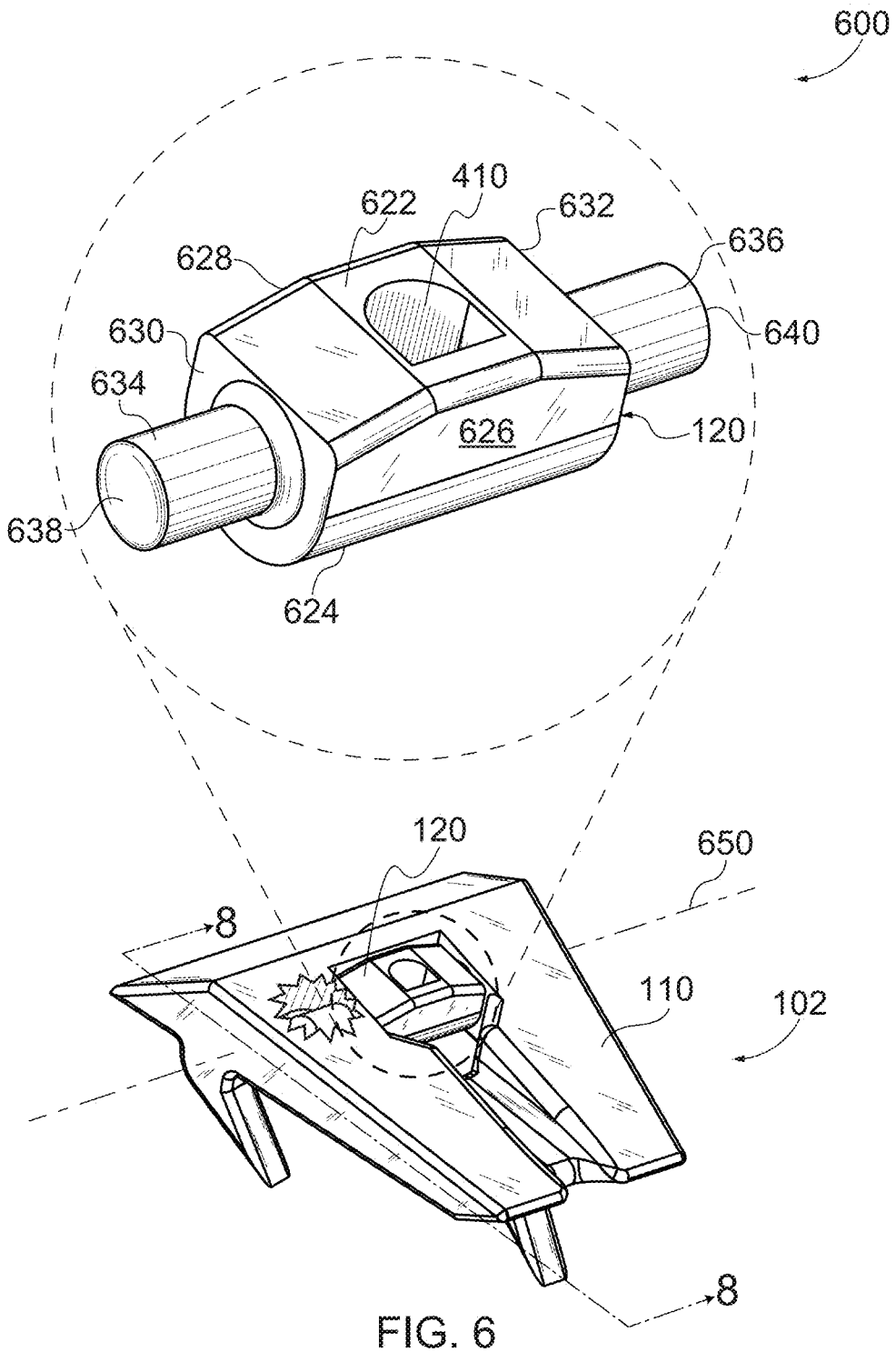
FIG. 6 illustrates an exploded perspective view of the tee assembly showing the structural relationship between the base member and hinge member components in an enlarged and displaced location to illustrate various features.

FIG. 6 illustrates an illustrative exploded perspective 600 of the tee assembly 102, revealing the detailed structural relationship between the base member 110 and the hinge member 120. The hinge member 120 includes a top 622 and a bottom 624, with the bottom 624 formed with a circular profile to facilitate rotational movement. The top 622 and the bottom 624 may be separated by a front 626, a back 628, a first side 630, and a second side 632. The front 626 and the back 628 may be substantially parallel to each other, while the first side 630 and the second side 632 may be substantially parallel to each other to maintain structural integrity during operation. A first pin 634 may protrude from the first side 630, and a second pin 636 may protrude from the second side 632. The first pin 634 may terminate with a first face 638, and the second pin 636 may terminate with a second face 640. These components are configured in the as-assembled configuration with the hinge member 120 being rotationally supported by the base member 110 along a hinge axis 650. The first pin 634 and the second pin 636 are coaxial and generally define the hinge axis 650 about which the hinge member 120 rotates (limited by the impact of various faces of the hinge member 120 against the base member 110).

The base member 110 includes corresponding structural features that accommodate the hinge member 120 in the assembled configuration. The base member 110 may include recesses or openings that receive the first pin 634 and the second pin 636, allowing the hinge member 120 to rotate about the hinge axis 650. The hinge axis 650 extends horizontally through the base member 110, providing a stable pivot point for the hinge member 120 during impact events. The structural arrangement disclosed in the illustrative exploded perspective 600 demonstrates how the components interface to create a durable and functional pivoting mechanism. The first face 638 and the second face 640 may include rounded or chamfered edges to reduce friction during rotation and prevent binding within the corresponding recesses of the base member 110.

Figure 7:
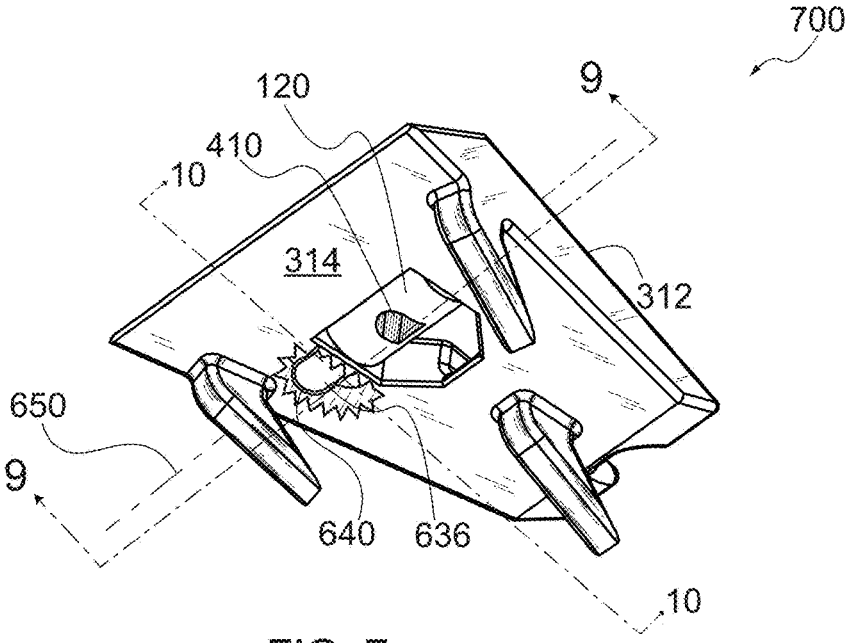
FIG. 7 illustrates a bottom view of a golf tee assembly with a broken-out section showing one configuration wherein the components are formed with a co-manufactured hinge configuration.

FIG. 7 illustrates a bottom perspective view 700 of the golf tee assembly with a broken-out section showing an illustrative configuration where the hinge member 120 may be co-manufactured with the base member 110. This configuration demonstrates how the components can be produced as a single, integrated unit through additive manufacturing processes, such as fused deposition manufacturing (FDM). The broken-out section reveals the internal relationship between the hinge member 120 and the base member 110, showing how the first pin 634 and the second pin 636 are positioned within corresponding holes formed in the base member 110. The bottom perspective view 700 provides visibility into the structural arrangement that enables the pivotal connection while maintaining the integrity of the overall assembly. In an illustrative configuration, the golf tee assembly may be manufactured through 3D printing processes where the first pin 634 and the second pin 636, along with their corresponding holes in the base member 110, are printed in place with specific tolerances to allow full rotation without post-processing.

Figure 8:
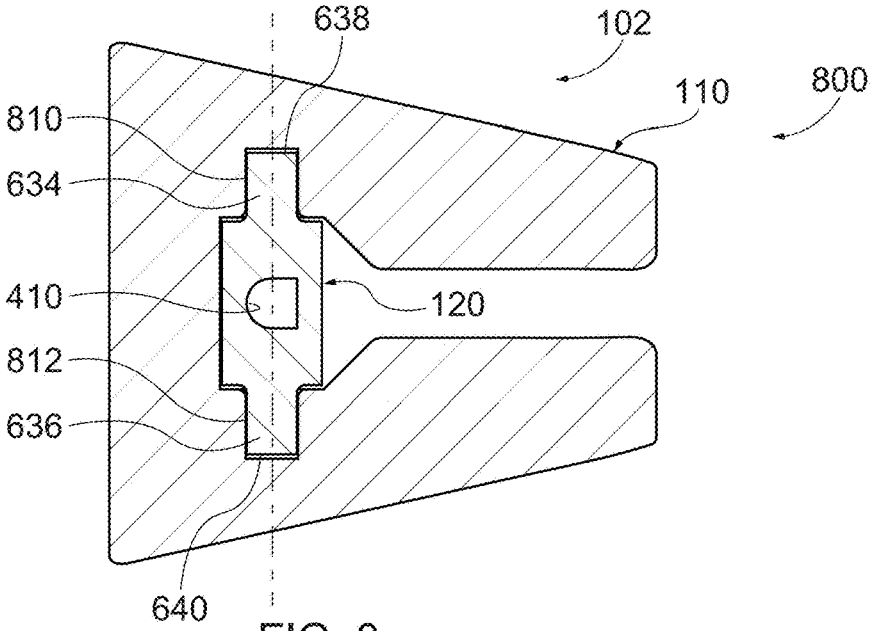
FIG. 8 illustrates a sectional view, taken across plane 8-8 in FIG. 6, of the golf tee assembly revealing the internal hinge mechanism and hole configuration.

FIG. 8 illustrates a horizontal cross-sectional view 800 taken along plane 8-8 from FIG. 6, revealing the internal configuration of the hinge mechanism during the manufacturing process. The sectional view shows a portion of the base member 110 and the detailed relationship between the hinge components. The hole 410 extends through the hinge member 120, providing an opening for receiving a tee shaft. FIG. 8 further shows a first hole 810 where the first pin 634 contacts the base member 110 and the rotational movement of the first pin 634 occurs. In other words, the first pin 634 is rotationally received in the base member 110 at the first hole 810. Similarly, a second hole 812 is where the second pin 636 contacts the base member 110 and the rotational movement of the second pin 636 occurs; thus, the second pin 636 is rotationally received in the base member 110 at the second hole 812. The manufacturing process disclosed allows the first pin 634 and the second pin 636 to be initially connected to their corresponding holes through frangible connections that can be subsequently separated to enable pivotal movement. This approach eliminates the need for post-processing assembly steps, resulting in a fully functional hinge mechanism that is created directly from the 3D printing process.

To be clear, the hinge pins (i.e., the first pin 634 and the second pin 636) and corresponding holes include clearance gaps (and any other design features such as, for example, fillets) to prevent permanent binding during the 3D printing process while maintaining smooth rotation. The clearance gaps ensure that the first pin 634 and the second pin 636 do not fuse with the walls of their corresponding recesses during the printing process. Fillets may be incorporated at the junction points between the pins and the hinge member 120 to distribute stress and provide smoother surfaces for rotation. Further, the first face 638 and the second face 640 may include similar clearance features to prevent binding while maintaining the structural connection between the hinge member 120 and the base member 110. These manufacturing considerations enable the production of a fully functional pivoting mechanism through a single additive manufacturing operation, reducing production complexity and assembly requirements.

Figure 9:
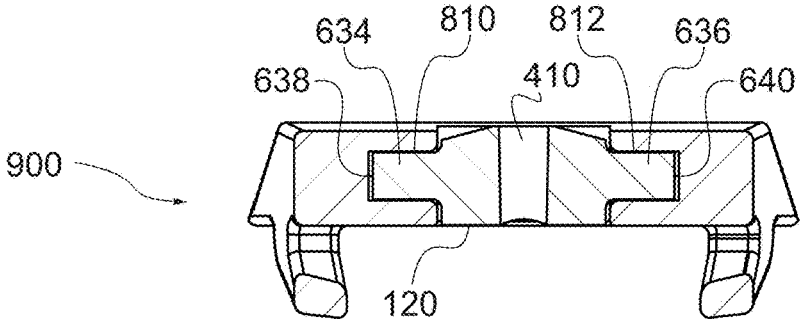
FIG. 9 illustrates a sectional view, taken across plane 9-9 in FIG. 7, of a hinge assembly showing the internal configuration of recesses and protrusions forming the pivotal connection.

FIG. 9 illustrates a vertical cross-sectional view 900 of a hinge assembly across plane 9-9 of FIG. 7 (wherein plane 9-9 is coplanar with hinge axis 650), showing the internal configuration of the pivotal connection between its components. The configuration disclosed in the tee assembly 102 enables precise rotational movement while maintaining structural integrity during operation. The interaction between the first pin 634 and the second pin 636 on the base member 110 provides additional support points that distribute loads across multiple contact areas.

Figure 10:
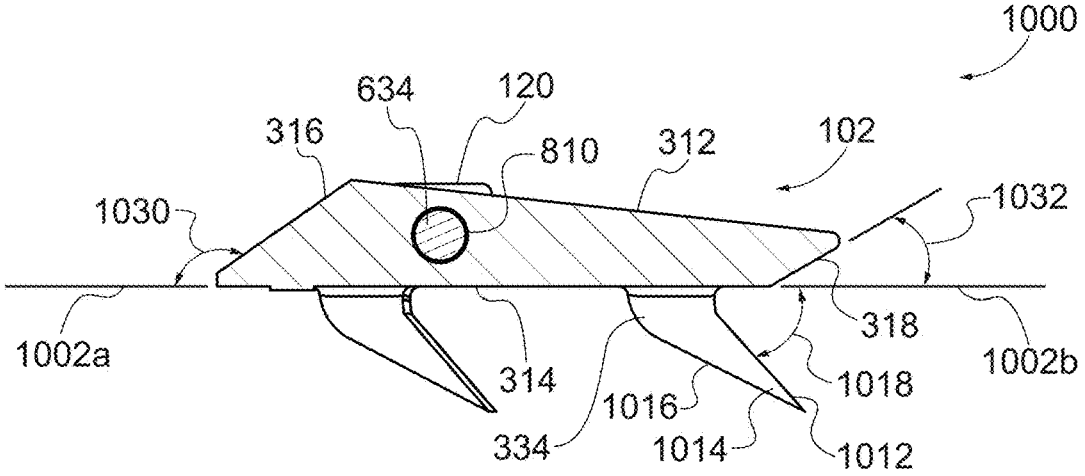
FIG. 10 illustrates a cross-sectional view, taken across plane 10-10 in FIG. 7, showing the geometry and angular relationships of the tee assembly between ground surfaces.

FIG. 10 illustrates a side cross-sectional view 1000 take across plane 10-10 in FIG. 7 revealing the geometry and angular relationships of one configuration of the tee assembly. The tee assembly 102 may be positioned on the ground (specifically illustrated as a first ground surface 1002*a* and a second ground surface 1002*b* that are coplanar with each other), demonstrating the operational environment of the device. The tee assembly 102 includes the hinge member 120, which includes the first pin 634 located in the first hole 810 of the base member 110 (and the second pin 636 located in the second hole 812 of the base member 110; not visible in FIG. 10), forming the primary pivot mechanism. The bottom surface 314 of the base member 110 includes a third turf engagement member 334 that forms an intersection angle 1018 with the second ground surface 1002*b*; the intersection angle 1018 may be roughly 45 degrees (but could be +/−40 degrees). The third turf engagement member 334 may have a wedged shape, as illustrated, with a second angle 1016 of about 20 degrees (plus or minus 15 degrees) for penetrating the ground. The front face 316 may intersect the first ground surface 1002*a* at a third angle 1030 of about 135 degrees (+/−40 degrees) for protecting the club as it bears down on the tee assembly 102. The back wall 318 may intersect the second ground surface 1002*b* at a fourth angle 1032 of about 45 degrees (+/−40 degrees) for easy removal of the tee assembly 102 from the ground.

With continued reference to FIG. 10, illustrating one configuration of a golf tee assembly 102, the assembly may include tuned friction characteristics achieved through precise control of tolerances and manufacturing parameters. The interaction between the first pin 634 and the first hole 810 (as well as the interaction between the second pin 636 and the second 812) can be configured with specific clearances that allow controlled resistance to rotation. The friction characteristics may be optimized to absorb energy during impact while preventing excessive deflection that could damage the tee shaft or compromise ball positioning. The pins and holes (e.g., first pin 634 and first hole 810) work in conjunction to provide additional bearing surfaces that distribute rotational loads and maintain smooth operation throughout the rotation angle. The hinge member 120 surrounding the connection point ensures that the hinge member 120 remains properly aligned while allowing the freedom of movement disclosed by the angular relationships. Moreover, base member 110 and associated third turf engagement members 334 provide a stable foundation that resists unwanted movement during the pivotal motion, thereby absorbing energy from striking the ball with the club.

Figure 11:
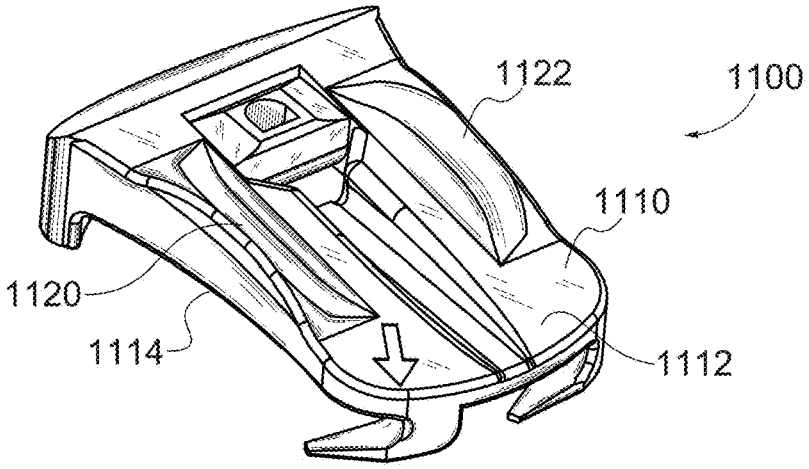
FIG. 11 illustrates a perspective view of a tee assembly configured for artificial turf applications with digit engagement surfaces.

FIG. 11 illustrates a perspective view 1100 of a tee assembly 1102 configured for artificial turf applications. The tee assembly 1102 includes a base member 1110 having a top surface 1112 and a bottom surface 1114. The base member 1110 includes a first digit surface 1120 and a second digit surface 1122 formed on the top surface 1112. The first digit surface 1120 and the second digit surface 1122 provide areas for digit engagement during operation of the tee assembly 1102. In this illustrative configuration, the first digit surface 1120 and the second digit surface 1122 may be positioned to provide visual cues for rotating the device into the artificial turf position. The first digit surface 1120 and the second digit surface 1122 may include textured or contoured configurations to facilitate secure gripping by a user's fingers during installation and removal operations.

Figure 12:
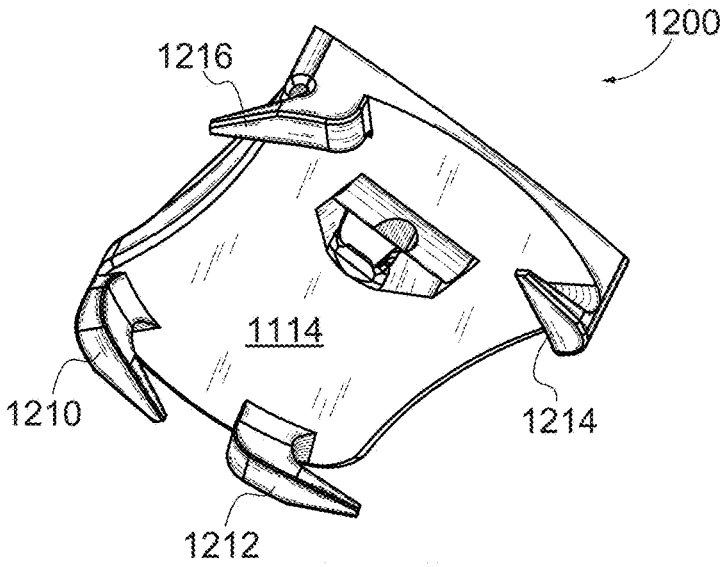
FIG. 12 illustrates an underside perspective view of the golf tee assembly showing multiple protrusions for artificial turf engagement.

FIG. 12 illustrates an underside perspective view 1200 of the tee assembly 1102 showing the specialized engagement features for artificial turf surfaces. The tee assembly 1102 includes the bottom surface 1114 from which multiple protrusions extend downwardly. A first protrusion 1212, a second protrusion 1214, a third protrusion 1216, and a fourth protrusion 1218 are configured on the bottom surface 1114. The first protrusion 1212, the second protrusion 1214, the third protrusion 1216, and the fourth protrusion 1218 extend from the bottom surface 1114 in a pattern that allows engagement with artificial turf surfaces. The first protrusion 1212, the second protrusion 1214, the third protrusion 1216, and the fourth protrusion 1218 may be configured as protrusions specifically designed to rotate and hook into loops of artificial turf surfaces commonly found on driving ranges. Additionally, the angular configuration of the first protrusion 1212, the second protrusion 1214, the third protrusion 1216, and the fourth protrusion 1218 may facilitate penetration and secure engagement with synthetic fiber materials.

In an illustrative configuration, the protrusions may be oriented at predetermined angles relative to the bottom surface 1114 to optimize engagement with artificial turf fibers. The first protrusion 1212, the second protrusion 1214, the third protrusion 1216, and the fourth protrusion 1218 may include curved or angled terminal portions that facilitate hooking action when rotated into contact with artificial turf loops. The spacing between the first protrusion 1212, the second protrusion 1214, the third protrusion 1216, and the fourth protrusion 1218 may be configured to distribute engagement forces across multiple contact points with the artificial turf surface. Moreover, the length and diameter of the first protrusion 1212, the second protrusion 1214, the third protrusion 1216, and the fourth protrusion 1218 may be optimized for different artificial turf pile heights and fiber densities commonly encountered in driving range applications.

Figure 13:
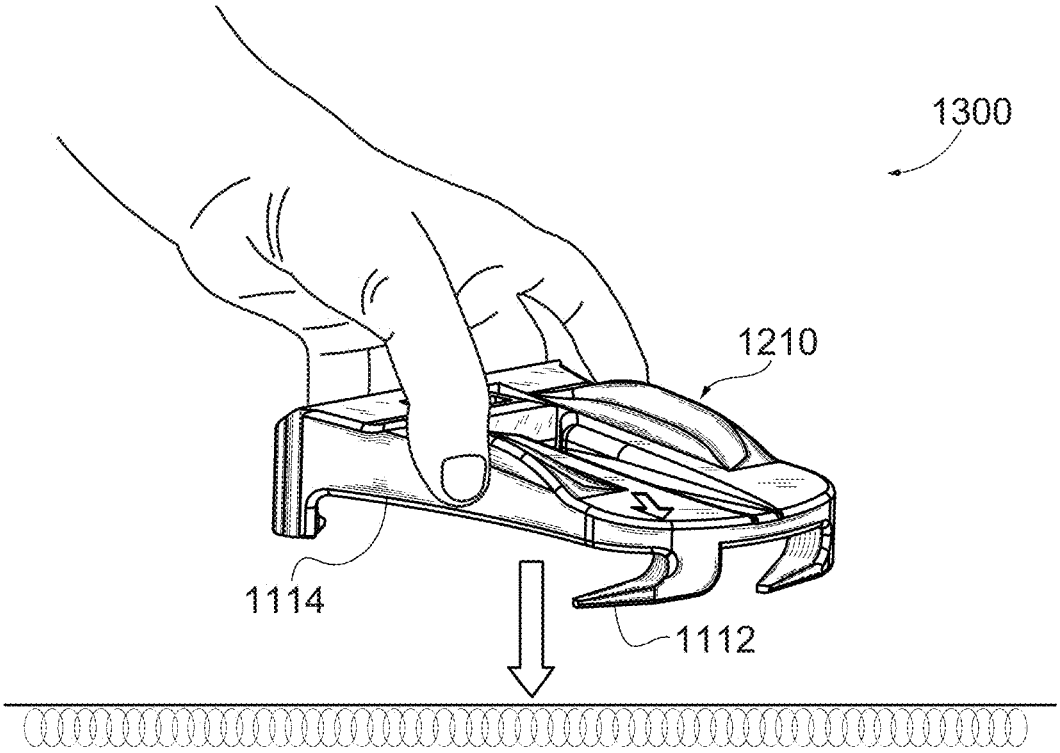
FIG. 13 illustrates a perspective view showing hand positioning of the finger grip during installation on an artificial turf surface.

FIG. 13 illustrates an installation perspective view 1300 showing a hand 1302 positioning a finger grip 1310 that extends from a device. The hand 1302 may position the golf tee assembly 1202 such that the bottom surface 1114 can engage with the underlying artificial turf surface. The finger grip 1210 may provide enhanced tactile feedback during rotational positioning operations. Consequently, the finger grip 1210 may facilitate precise angular positioning of the protrusions relative to the orientation of the artificial turf fibers. The hand 1302 may apply rotational forces through the finger grip 1210 to achieve optimal engagement between the protrusions and the artificial turf loops.

Figure 14:
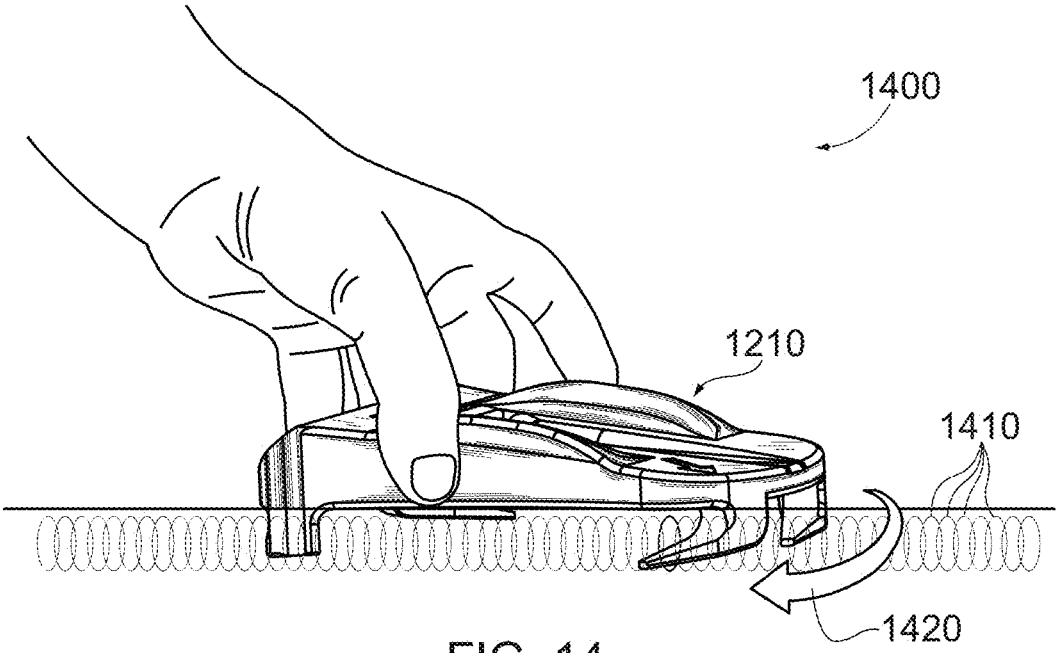
FIG. 14 illustrates a cross-sectional view of the base portion supporting the hinge mechanism in the artificial turf configuration.

FIG. 14 illustrates a cross-sectional view 1400 showing the golf tee assembly 1202 interfaced with the artificial turf, wherein the golf tee assembly 1202 is securely engaged with the artificial turf surface.

Figure 15:
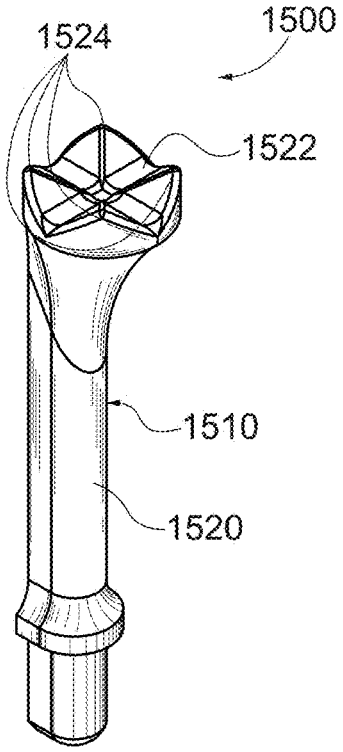
FIG. 15 illustrates a top-front perspective view of an additive golf tee.

FIG. 15 illustrates a top-front perspective view 1500 of an additive golf tee 1510 in which a tee shaft 1520 incorporates several specialized design features that enhance performance and durability during golf ball impact. Unlike traditional tee constructions that utilize centered and symmetrical designs, the tee shaft 1520 features an off-center configuration, providing improved strength characteristics. This asymmetrical design redistributes stress forces during impact, reducing the likelihood of structural failure at the point of ball contact. The off-center construction allows the tee shaft 1520 to withstand the lateral forces generated when a golf club strikes the ball more effectively, particularly during high-velocity drives where impact forces can be substantial. A head 1522 of the tee shaft 1520 features a four-point crown 1524 configuration that minimizes surface area contact with the golf ball 16. This reduced contact area decreases friction and resistance during ball contact, allowing for cleaner separation between the ball and tee during the golf swing. The four-point design creates discrete contact points rather than a continuous surface, which can reduce drag forces that might otherwise affect ball trajectory. Additionally, the minimal surface area configuration helps prevent the tee shaft 1520 from interfering with the natural flight path of the golf ball 16 immediately following impact.

Figure 16:
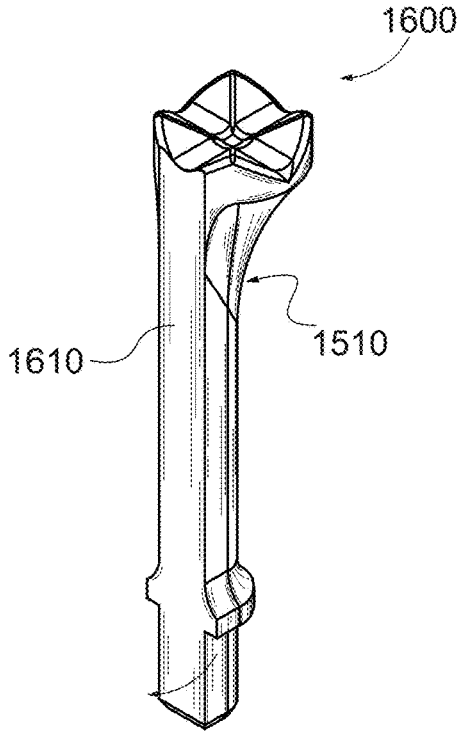
FIG. 16 illustrates a top-back perspective view of the additive golf tee of FIG. 15.

FIG. 16 illustrates a top-back perspective view 1600 of the additive golf tee 1510, provided with a longitudinal flat 1610 that extends the entire length of the additive golf tee 1510. The longitudinal flat 1610 improves manufacturability by providing a flat, contiguous surface adjoining the print bed in an additive manufacturing process. The orientation of the longitudinal flat 1610 may also improve the build plane orientation enabling the additive golf tee 1510, whereby the individual layers are oriented such that the drive of a golf ball positioned on the additive golf tee 1510 does not necessarily break the additive golf tee 1510.

Figure 17:
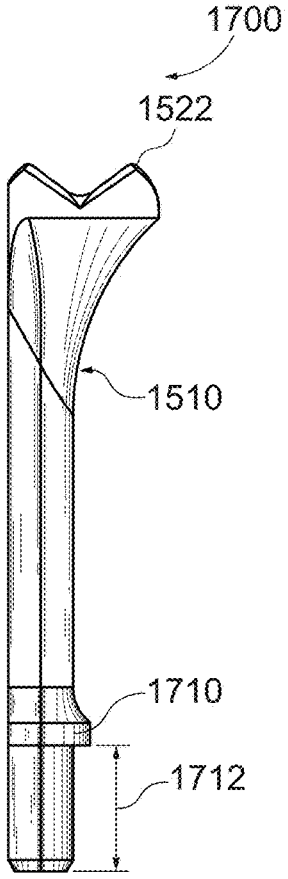
FIG. 17 illustrates a side elevation view of the additive golf tee of FIG. 15.

FIG. 17 illustrates a side elevation view 1700 of the additive golf tee 1510 provided with a collar 1710 positioned along its length to control insertion depth 1712 within the hole 410 (FIG. 6) of the hinge member 120 (FIG. 6). The collar 1710 serves as a depth-limiting mechanism, preventing the additive golf tee 1510 from being pushed too far down into the hinge member 120 during installation. The collar 1710 maintains proper positioning of the head 1522 relative to the base member 110 (FIG. 6), ensuring consistent ball height regardless of installation force or ground conditions (for example). The collar 1710 also facilitates easier removal of the additive golf tee 1510 from the hole 410 following use. In cases where the additive golf tee 1510 becomes lodged within the hinge member 120, the collar provides a gripping surface that allows users to extract it without damaging either component. The collar 1710 may be configured to provide an interference fit with the hole (central cavity), creating sufficient friction to maintain the additive golf tee 1510 in position during normal handling while still allowing removal when desired. This design approach eliminates the need for additional fastening mechanisms or adhesives that might complicate the assembly or disassembly process.

Figure 18:
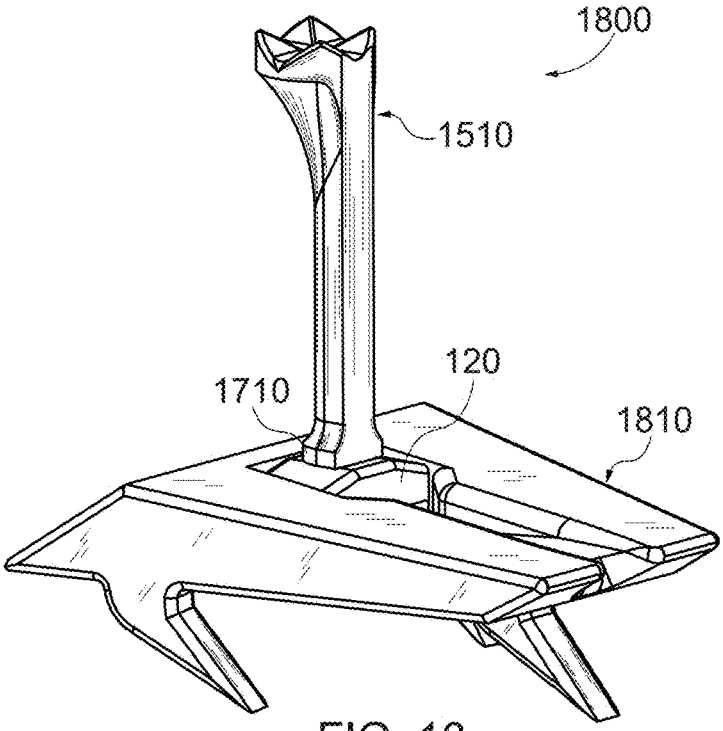
FIG. 18 illustrates a back elevation view of a golf tee assembly provided with the additive golf tee of FIG. 15.

FIG. 18 illustrates a back elevation view 1800 of a golf tee assembly 1510 provided with the additive golf tee 1510 as described in FIG. 17. As shown in FIG. 18, the collar 1710 limits the (relatively) downward movement of the additive golf tee 1510 when the collar 1710 contacts the hinge member 120.

Figure 19:
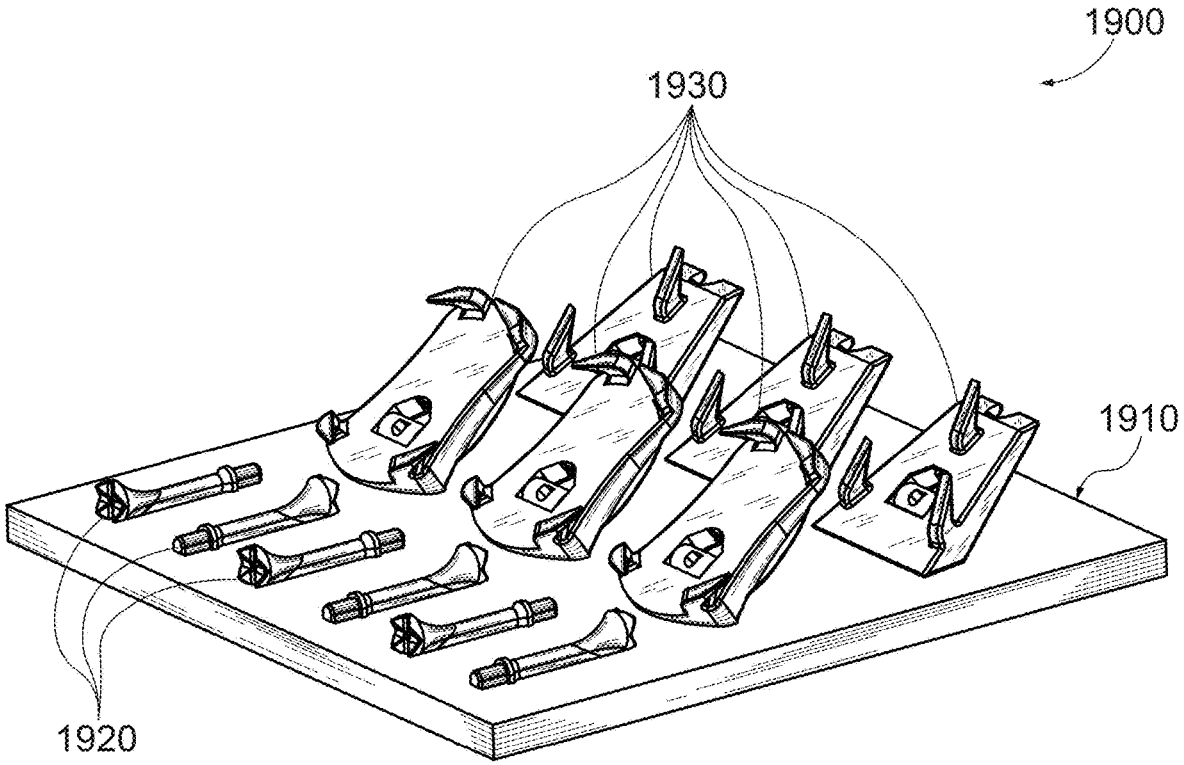
FIG. 19 illustrates a build plate perspective view of an additive build plate with a plurality of additive golf tees and various configurations of golf tee assemblies.

FIG. 19 illustrates a build plate perspective view 1900 of an additive build plate 1910 with a plurality of additive golf tees 1920 and various configurations of golf tee assemblies 1930. This orientation positions the build planes (sometimes referred to in the industry as build lines) in a manner compatible with the additive manufacturing process (e.g., fused deposition modeling, FDM). The various features are configured to be manufactured without the use of supports. The hinge member and the base member are printed, allowing them to rotate freely relative to each other (although this may require a few operations to break insignificant amounts of material free intentionally).

In one alternative embodiment, the hinge member may be manufactured as a first step and later snapped into the base member. Or, in another embodiment, the hinge member may be made in its own injection molding cavity and then the base may be over molded with a material that does not bond to the hinge member. In yet another embodiment, the entire assembly may be pinned together with separable pins. All of these various embodiments are provided as alternatives to the main embodiments disclosed herein.

The methods, systems, devices, graphs, and/or tables are illustrative examples, and configurations may omit, substitute, or add various procedures or components as appropriate. For instance, the methods may be reordered in alternative configurations, and/or various stages may be added, omitted, and/or combined. Alternatively, features described with respect to certain configurations may be in various alternative configurations. Different aspects and elements of the configurations may be combined similarly. Also, technology evolves; thus, many of the elements are examples and do not limit the scope of the disclosure or claims. Additionally, the techniques discussed herein may provide differing results with different types of context awareness classifiers.

Unless defined otherwise, all technical and scientific terms used herein have the same meaning as commonly or conventionally understood. As used herein, the articles "a" and "an" refer to one or more than one (i.e., to at least one) of the grammatical object of the article. By way of example, "an element" means one element or more than one element. "About" and/or "approximately" as used herein when referring to a measurable value such as an amount, a temporal duration, and the like encompass variations of 20% or +10%, +5%, or +0.1% from the specified value as such variations are appropriate in the context of the systems, devices, circuits, methods, and other implementations described herein. "Substantially," as used herein when referring to a measurable value such as an amount, a temporal duration, a physical attribute (such as frequency), and the like, also encompasses variations of 20% or +10%, +5%, or +0.1% from the specified value as such variations are appropriate in the context of the systems, devices, circuits, methods, and other implementations described herein.

As used herein, including in the claims, "and" as used in a list of items prefaced by "at least one of" or "one or more of" indicates that any combination of the listed items may be utilized. For example, a list of "at least one of A, B, and C" includes any of the combinations A, B, C, AB, AC, BC, and/or ABC (i.e., A, B, and C). Furthermore, to the extent more than one occurrence or use of the items A, B, or C is possible, multiple uses of A, B, and/or C may form part of the contemplated combinations. For example, a list of "at least one of A, B, and C" may include AA, AAB, AAA, BB, etc.

While illustrative and presently preferred embodiments of the disclosed systems, methods, and/or machine-readable media have been described in detail herein, it is to be understood that the inventive concepts may be otherwise variously embodied and employed and that the appended claims are intended to be construed to include such variations except as limited by the prior art. While the principles of the disclosure have been provided in connection with specific apparatuses and methods, it is to be clearly understood that this description is made only by way of example and not as a limitation on the scope of the disclosure.

What is claimed is:

1. A golf tee assembly, comprising:

a base member comprising:

a top surface, a bottom surface disposed opposite the top surface, at least one turf engagement member extending downwardly from the bottom surface and configured to engage with a ground surface; and a hinge member pivotally connected to the base member and configured to rotate about a horizontal hinge axis, the hinge member comprising:

a hole extending completely through the hinge member from a top to a bottom and configured to removably receive a tee shaft in a friction-fit engagement that securely holds the tee shaft, wherein the hinge member is configured to pivot from an upright position to a deflected position when subjected to an impact force from a golf club, thereby allowing the tee shaft to rotate without becoming damaged.

2. The golf tee assembly of claim 1, wherein the hinge member is returnable to the upright position after rotation due to structural configuration of the hinge member and base member connection.

3. The golf tee assembly of claim 1, wherein the hole comprises:

at least one registration feature configured to align the tee shaft with the hinge member, the at least one registration feature providing rotational orientation between the tee shaft and the hinge member to maintain proper positioning during use.

4. The golf tee assembly of claim 1, wherein the horizontal hinge axis is positioned below a top surface of the base member and above the bottom surface, allowing the hinge member to pivot through a predetermined range of motion while remaining operatively connected to the base member.

5. The golf tee assembly of claim 1, wherein:

the hinge member comprises at least one pin extending laterally therefrom, and the base member comprises at least one corresponding recess configured to receive the at least one pin, thereby forming a rotational connection between the hinge member and the base member.

6. The golf tee assembly of claim 1, wherein the top surface of the base member comprises at least one digit engagement surface.

7. The golf tee assembly of claim 6 and further comprising:

a textured or contoured configuration formed on the at least one digit engagement surface to facilitate secure gripping of the golf tee assembly by a user's fingers during installation and removal.

8. The golf tee assembly of claim 1, wherein the golf tee assembly is formed as a single integrated unit through additive manufacturing processes, wherein a pin formed on the hinge member and a corresponding hole formed in the base member are initially frangibly connected and subsequently separated to enable pivotal movement.

9. A method of using a golf tee assembly, comprising:

positioning a base member on a ground surface, the base member having a top surface, a bottom surface disposed opposite the top surface, and at least one turf engagement member extending downwardly from the bottom surface;

inserting a tee shaft into a hole that extends completely through a hinge member from a top end to a bottom end, the tee shaft being removably received in a friction-fit engagement within the hole, wherein the hinge member is attached to the base member at a pivotal connection and is configured to rotate about a horizontal hinge axis relative to the base member;

placing a golf ball on the tee shaft; and striking the golf ball with a golf club, wherein an impact force causes the hinge member to pivot from an upright position to a deflected position, thereby allowing the tee shaft to rotate without becoming damaged.

10. The method of claim 9, further comprising:

returning the hinge member to the upright position after deflection due to a biasing force provided by structural configuration of the hinge member and base member connection.

11. The method of claim 9, wherein inserting the tee shaft further comprises:

aligning the tee shaft with the hinge member using at least one registration feature within the hole, the at least one registration feature providing rotational orientation between the tee shaft and the hinge member to maintain proper positioning during use.

12. The method of claim 9, wherein positioning the base member comprises:

engaging the at least one turf engagement member with the ground surface while the horizontal hinge axis remains positioned below the top surface of the base member and above the bottom surface.

13. The method of claim 9, wherein positioning the base member comprises:

engaging at least one pin extending laterally from the hinge member with at least one corresponding recess in the base member to form the pivotal connection.

14. The method of claim 9, further comprising:

gripping at least one digit engagement surface on the top surface of the base member during positioning, the at least one digit engagement surface having a textured or contoured configuration to facilitate secure gripping by a user's fingers.

15. The method of claim 9, wherein the golf tee assembly is formed as a single integrated unit through additive manufacturing processes, and the method further comprises separating a frangible connection between a pin formed on the hinge member and a corresponding hole formed in the base member to enable pivotal movement prior to use.

* * * * *